US007857691B2

(12) United States Patent
Head et al.

(10) Patent No.: US 7,857,691 B2
(45) Date of Patent: Dec. 28, 2010

(54) ENTERTAINMENT SYSTEM AND METHOD OF OPERATION THEREOF

(75) Inventors: Robert James Head, Ipswich (GB); Neil Hewitson, Ipswich (GB); Matthew David, Ipswich (GB); Thomas David, Ipswich (GB); Stuart Powell, Ipswich (GB); Matthew Killgallon, Ipswich (GB)

(73) Assignee: Waterleaf Limited, Douglas, Isle of Man (GB)

( * ) Notice: Subject to any disclaimer, the term of this patent is extended or adjusted under 35 U.S.C. 154(b) by 160 days.

(21) Appl. No.: 11/721,945

(22) PCT Filed: Dec. 16, 2005

(86) PCT No.: PCT/GB2005/004837

§ 371 (c)(1),
(2), (4) Date: Jul. 22, 2009

(87) PCT Pub. No.: WO2006/064238

PCT Pub. Date: Jun. 22, 2006

(65) Prior Publication Data

US 2009/0312081 A1 Dec. 17, 2009

(30) Foreign Application Priority Data

Dec. 17, 2004 (GB) ..... 0427653.1

(51) Int. Cl.
*A63F 9/24* (2006.01)

(52) U.S. Cl. ..... 463/8; 463/25; 463/40; 463/43

(58) Field of Classification Search ..... 463/8, 463/9, 10, 20, 25, 40, 43
See application file for complete search history.

(56) References Cited

U.S. PATENT DOCUMENTS

| | | | | |
|---|---|---|---|---|
| 6,110,041 | A | 8/2000 | Walker et al. | |
| 6,746,327 | B2 * | 6/2004 | Frohm et al. | 463/16 |
| 6,786,824 | B2 * | 9/2004 | Cannon | 463/42 |
| 2001/0039204 | A1 | 11/2001 | Tanskanen | |
| 2004/0063481 | A1 * | 4/2004 | Wang | 463/8 |
| 2004/0142740 | A1 * | 7/2004 | Damico et al. | 463/20 |
| 2004/0204216 | A1 * | 10/2004 | Schugar | 463/16 |
| 2004/0229671 | A1 | 11/2004 | Stronach et al. | |
| 2005/0239538 | A1 * | 10/2005 | Dixon | 463/20 |

* cited by examiner

FOREIGN PATENT DOCUMENTS

WO 2003/026754 A1 4/2003

OTHER PUBLICATIONS

European Patent Office, International Preliminary Report on Patentability for PCT Application No. PCT/GB2005/004837, Jun. 19, 2007.

*Primary Examiner*—James S McClellan
*Assistant Examiner*—Brandon Gray
(74) *Attorney, Agent, or Firm*—McDonnell Boehnen Hulbert & Berghoff, LLP

(57) ABSTRACT

An entertainment system (1) comprises a gaming server (2), a player station (3) operable by a player to display a simulation of a multi-stage accumulator game having a boxing theme, and a communication network (4) providing communication between the gaming server (2) and the player station (3). The gaming server (2) operates under stored program control to regulate the progress of the game and to determine an outcome thereof. The player places a wager on the outcome of the game, which is either a successful outcome in which the player wins a prize, and an unsuccessful outcome in which the player forfeits the wager. The prize may either be collected by the player or carried over as a wager for a succeeding stage of the multi-stage accumulator game.

23 Claims, 4 Drawing Sheets

ENTERTAINMENT SYSTEM AND METHOD OF OPERATION THEREOF

FIELD OF THE INVENTION

This invention relates to an entertainment system that enables a player thereof to place a wager on, and to play, a game and, more particularly, to a system which enables a player thereof to place a wager on, and to play, a game of chance. The invention extends to a method of operation of the gaming system.

BACKGROUND TO THE INVENTION

Entertainment systems for playing wagering games are widely known and utilised. Such systems can be used in land-based casino establishments or can be applied in an online environment. It has become increasingly common for such gaming systems to operate under the control of a stored software program.

A disadvantage of such entertainment systems is that players can quickly tire of a particular game, leading to player attrition and consequent reduced turnover and reduced profitability for an operator of the game.

It is desirable to have an entertainment system that provides players with a new and interesting game of chance and that will stimulate player's interest in playing the game.

OBJECT OF THE INVENTION

It is an object of this invention to provide an entertainment system, and a method of operation thereof that will, at least partially, alleviate the above-mentioned difficulties and disadvantages.

SUMMARY OF THE INVENTION

In accordance with this invention, there is provided an entertainment system, comprising:

a gaming server operable under program control to regulate the progress of a game of chance;

a communication network providing communication between the gaming server and a player station operable by a player to display a simulation of the game of chance; and a wagering means operable by the player to place a wager on an outcome of the game of chance, the outcome being either a successful outcome in which the player wins a prize, and an unsuccessful outcome in which the player forfeits the wager characterised in that the game of chance is a multi-stage accumulator game having a boxing theme.

Further features of the invention provide for each stage of the multi-stage accumulator game to comprise a simulation of a boxing contest, for the player station to enable the player to select two participants for the boxing contest from a pool of available participants each having a corresponding skill rating, one of the two selected participants representing the player, and for the gaming server to determine payout odds for the player's wager as a function of the two participants selected by the player for the boxing contest from the pool of available participants.

Still further features of the invention provide for the gaming server to determine the winner of the boxing contest randomly as a function of the respective skill ratings of the two participants selected by the player, for the outcome of the game to be a successful outcome if the gaming server determines the participant representing the player to be the winner of the boxing contest, and for the player's prize for the successful outcome to be settlement of the wager at the predetermined payout odds determined by the gaming server.

Yet further features of the invention provide for the player's prize to be selectively collected or carried over as a wager for a succeeding boxing contest, for the game to terminate automatically when the player collects the prize or when the player's prize exceeds a predetermined threshold, and for the simulation of the boxing contest to be an animated bout.

A method of operation of an entertainment system, comprising the steps of:

operating a gaming server under program control to regulate the progress of a game of chance;

displaying a simulation of the game of chance on a player station;

providing communication between the gaming server and the player station;

placing a wager on an outcome of the game of chance, the outcome being either a successful outcome in which a prize is won, and an unsuccessful outcome in which the wager is forfeited characterised in that the game of chance is a multi-stage accumulator game having a boxing theme.

There is further provided for displaying each stage of the multi-stage accumulator game as a simulation of a boxing contest, for receiving a player selection of two participants for the boxing contest from a pool of available participants each having a corresponding skill rating, one of the two selected participants representing the player, and for determining payout odds for the player's wager as a function of the two participants selected for the boxing contest from the pool of available participants.

There is still further provided for determining the winner of the boxing contest randomly as a function of the respective skill ratings of the two selected participants, for the outcome of the game to be a successful outcome if the participant representing the player is determined to be the winner of the boxing contest, and for awarding a prize for the successful outcome as settlement of the wager at the predetermined payout odds.

There is yet further provided for selectively collecting the prize or carrying the prize over as a wager for a succeeding boxing contest, for terminating the game automatically when the prize is collected or when the prize exceeds a predetermined threshold, and for displaying the simulation of the boxing contest as an animated bout.

BRIEF DESCRIPTION OF THE DRAWINGS

A preferred embodiment of the invention is described below, by way of example only, and with reference to the accompanying drawings in which.

DETAILED DESCRIPTION OF THE INVENTION

Figure 1:
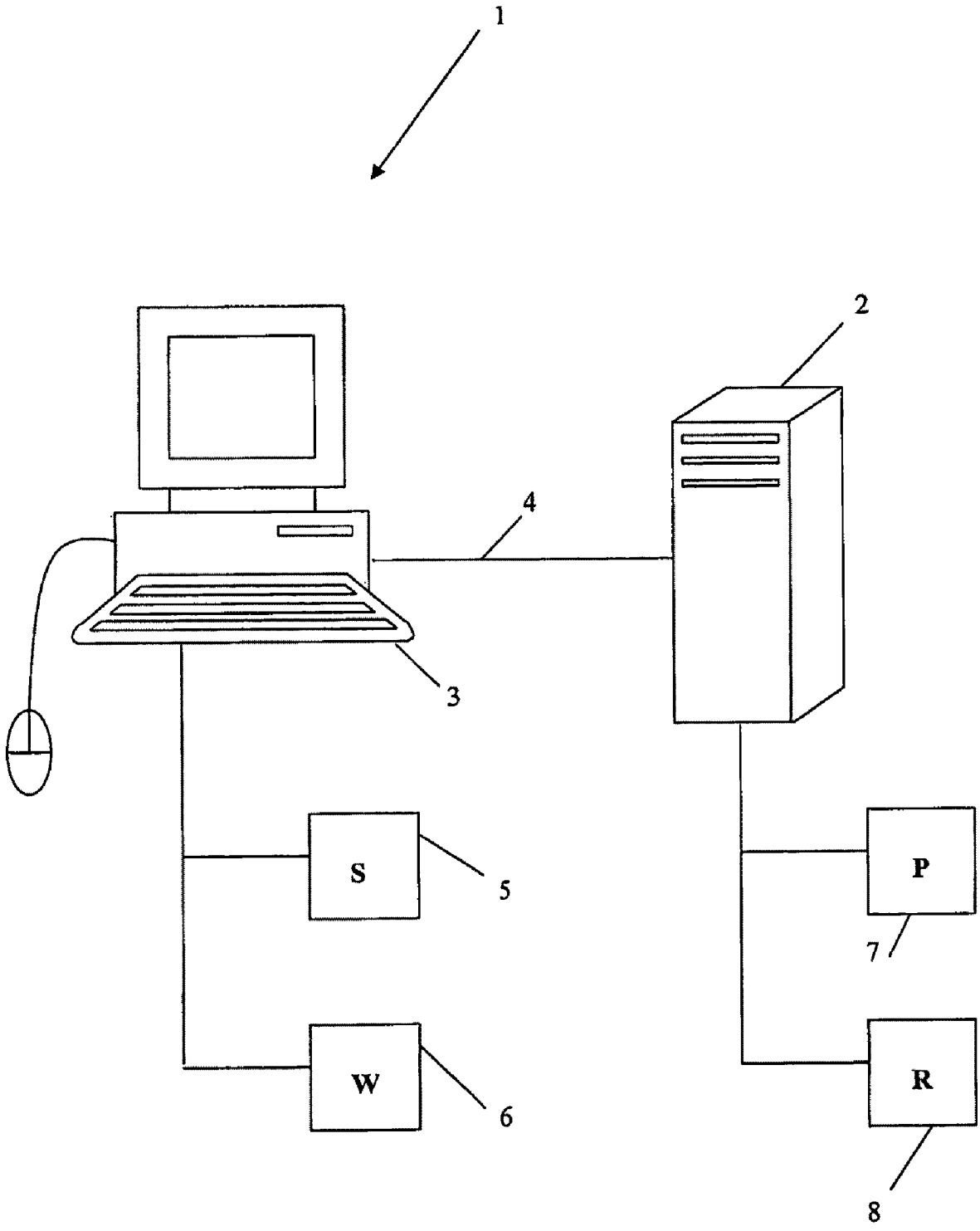
FIG. 1 is a schematic representation of an entertainment system according to the invention.

Referring to FIG. 1, an entertainment system is indicated generally by reference numeral (1).

The entertainment system (1) includes a gaming server (2) and a player station in the form of a computer workstation (3) remote from the gaming server. The computer workstation (3), which has an associated display, is located remotely from the gaming server (2) and is connected thereto by means of an open communication network (4) that is, in this embodiment, the Internet.

The gaming server (2) operates under the control of a stored program (7). The computer workstation (3) is a conventional personal computer operating under a Windows XP operating system, which is well known and commercially available from the Microsoft Corporation of Seattle, Wash., USA. The computer workstation (3) executes a stored simulation software program (5) that simulates the progress of a game of chance. The operation of the stored simulation software program (5) will be described in more detail in the description that follows.

A player wishing to play the game of chance is first required to register and to create an account on the gaming server (2). The player is then require to pre-fund the account by purchasing credit that will, for convenience, be denominated in this description in "units". The gaming server (2) stores, at all times, a credit balance corresponding to the player's account.

Figure 2:
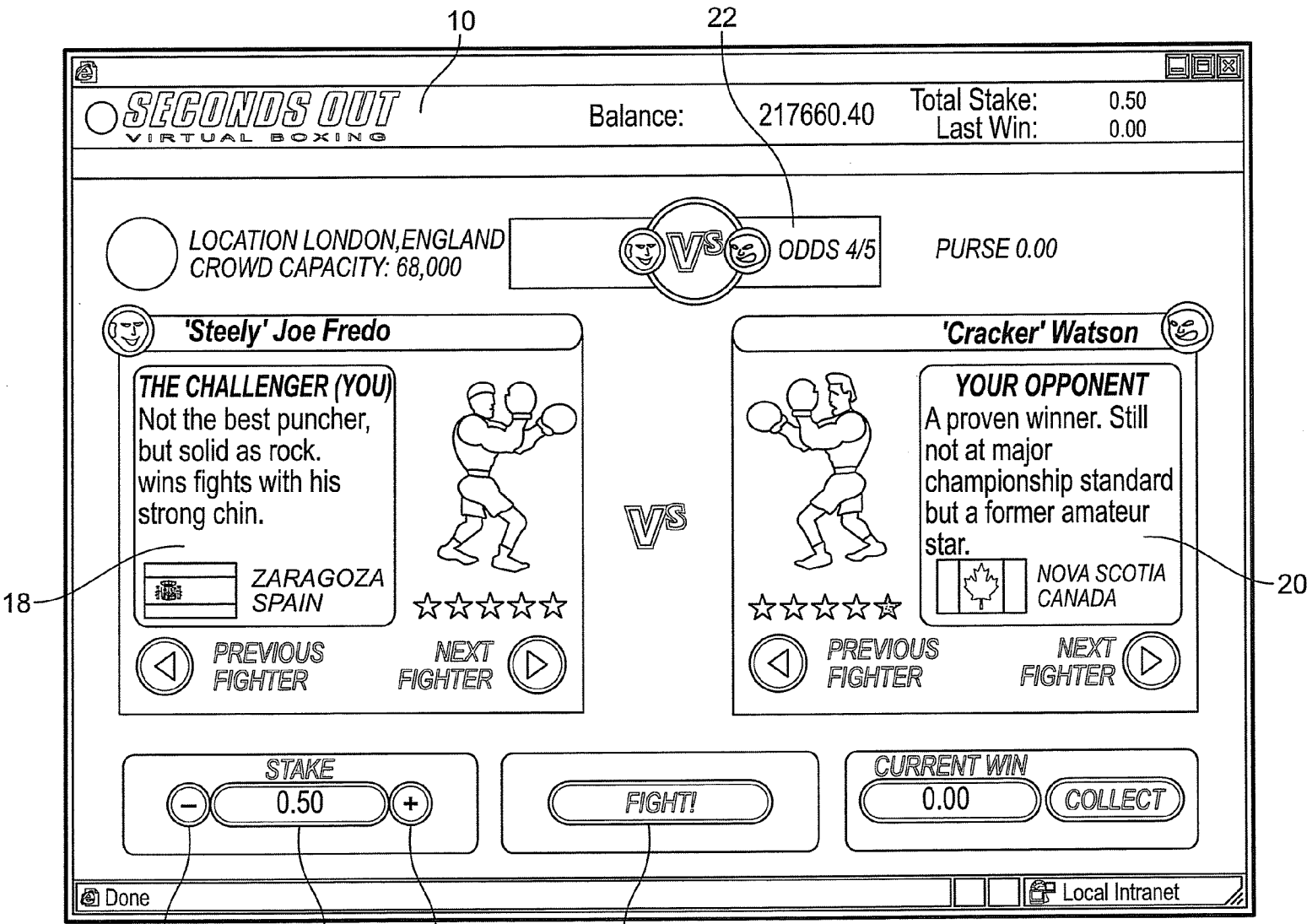
FIG. 2 is an opening selection display of the entertainment system of FIG. 1.

In order to commence play, the player uses the computer workstation (3) to log onto the gaming server (2) and initiates execution of the stored simulation software program (5), which provides the player with a graphical user interface ("GUI") on the display of the computer workstation (3). The GUI presents to the player an opening selection display (10) as shown in FIG. 2. The GUI provides the player with a wagering facility (6) in the form of bet placement icons (12, 14) that enable the player to place a wager on a turn of the game. The player now enters a betting phase of the game by activating the bet placement icons (12, 14) in order to place the wager. The GUI displays the size of the wager (16) to the player on the computer workstation (3). There must be sufficient credit in the player's account to cover any wager that is made. Data relating to the size of the wager made by the player is transmitted by the computer workstation (3) across the communication network (4) to the gaming server (2) for storage on an associated storage device (not shown).

Figure 3:
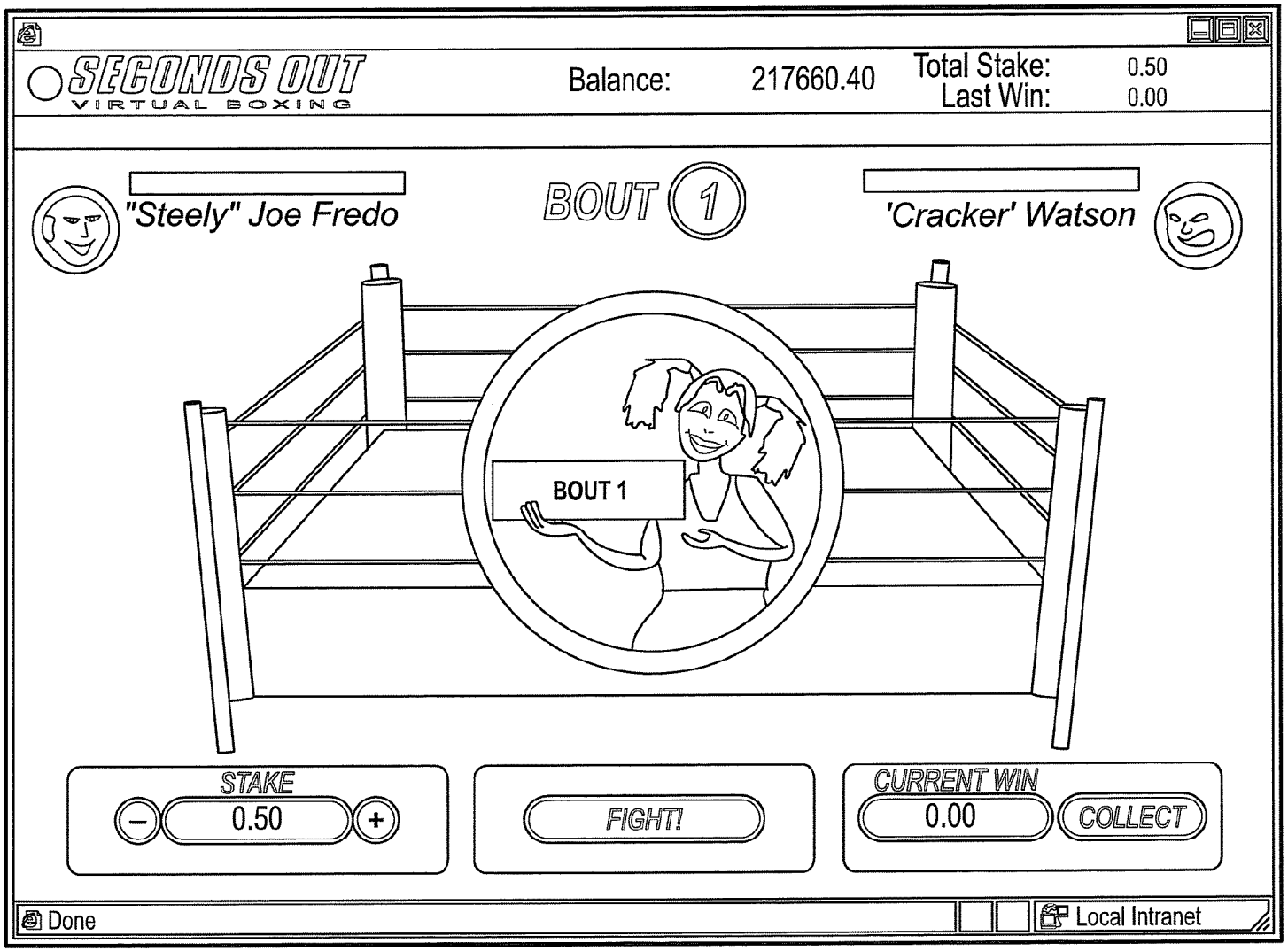
FIG. 3 is a boxing bout commencement display of the entertainment system of FIG. 1.
Figure 4:
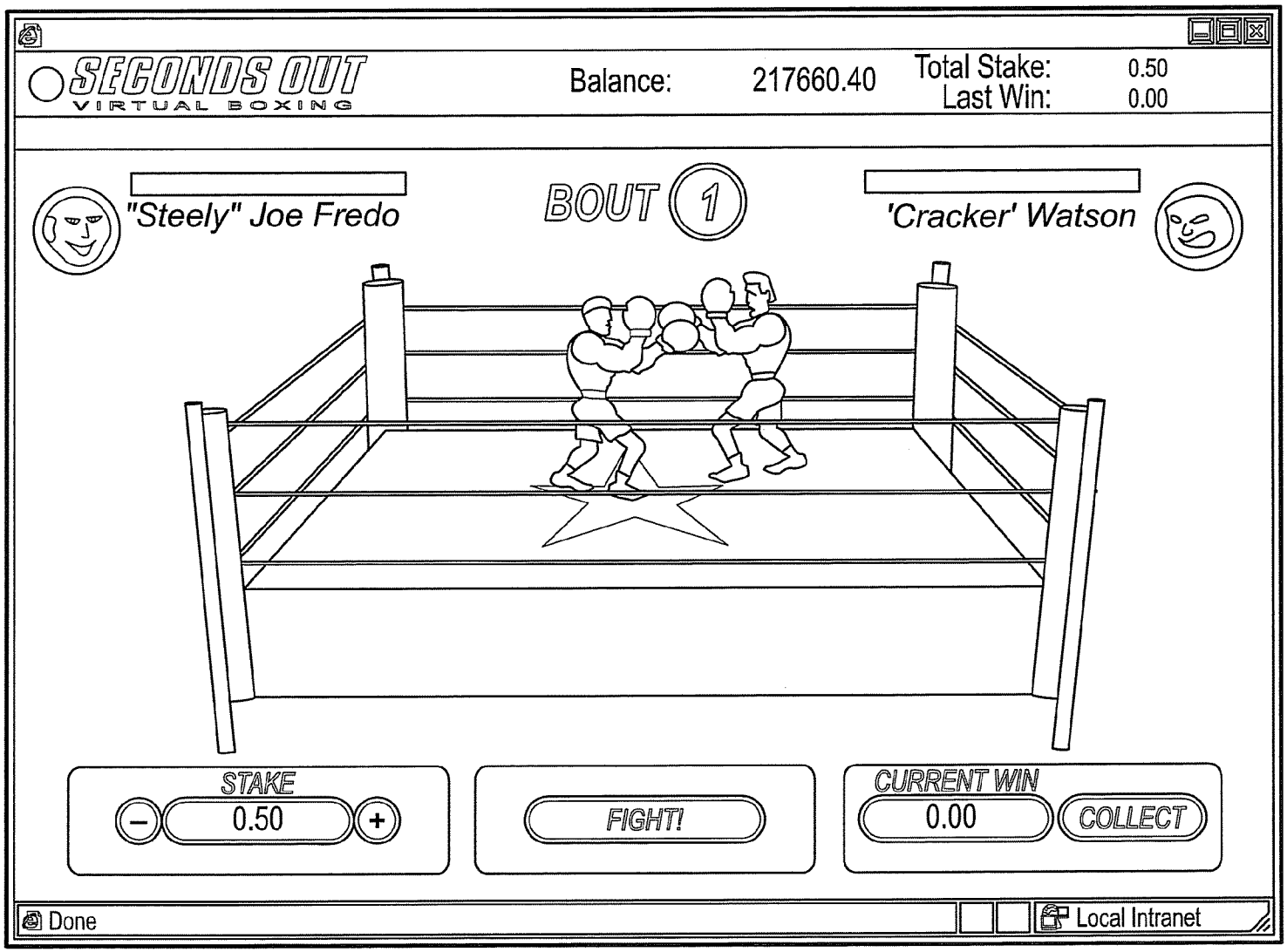
FIG. 4 is a boxing bout simulation display of the entertainment system of FIG. 1.

Once the player has placed a wager in the above manner, the stored simulation software program (5) displays to the player of the system (1) an animation of a multi-round boxing tournament, as illustrated in FIGS. 3 and 4.

In each round of the game, the player is required to select two boxing characters (18, 20) from a pool of 12 available boxers, a first one (18) of the two boxing characters for a role of "Challenger" representing the player, and a second one (20) for the role of "Opponent" against whom the Challenger will fight in a simulated boxing match. Each boxing character in the pool is identified by a corresponding name and has a corresponding skill rating, ranging from 5 to 31, as illustrated in the table below.

| Boxer No. | Name | Rating |
|---|---|---|
| 1 | 'Boxcar' McGraw | 5 |
| 2 | 'Tornado' Smith | 7 |
| 3 | 'Angel' McCready | 8 |
| 4 | 'Stonewall' Johnson | 10 |
| 5 | Jerry 'The Earl' | 13 |
| 6 | 'Bomber' Smith | 17 |
| 7 | Kenny 'The Iceman' | 19 |
| 8 | 'Super' Errol Barker | 24 |
| 9 | Carlos 'Adios' Salez | 25 |
| 10 | 'Cracker' Watson | 27 |
| 11 | 'Steely' Joe Fredo | 30 |
| 12 | 'One-punch' Le Rue | 31 |

The names of the selected Challenger and Opponent and a brief resume of each are displayed to the player on the display of the computer workstation (3), as well as payout odds (22) applicable to the player's wager should the simulated boxing contest between the selected Challenger and the Opponent be won by the Challenger.

It will be appreciated that there are 132 possible combinations of Challenger and Opponent. The following table lists, for each possible combination of Challenger and Opponent, the real odds of the Challenger winning the boxing contest, as well as the odds offered to the player by the gaming server (2).

TABLE

| Challenger | Opponent | Real Odds | 100% PO | Payout odds |
|---|---|---|---|---|
| 1 | 2 | 0.416666667 | 2.4 | 5 to 4 |
| 1 | 3 | 0.384615385 | 2.6 | 7 to 5 |
| 1 | 4 | 0.333333333 | 3 | 9 to 5 |
| 1 | 5 | 0.277777778 | 3.6 | 12 to 5 |
| 1 | 6 | 0.227272727 | 4.4 | 3 to 1 |
| 1 | 7 | 0.208333333 | 4.8 | 7 to 2 |
| 1 | 8 | 0.172413793 | 5.8 | 9 to 2 |
| 1 | 9 | 0.166666667 | 6 | 9 to 2 |
| 1 | 10 | 0.15625 | 6.4 | 5 to 1 |
| 1 | 11 | 0.142857143 | 7 | 11 to 2 |
| 1 | 12 | 0.138888889 | 7.2 | 11 to 2 |
| 2 | 1 | 0.583333333 | 1.714286 | 8 to 13 |
| 2 | 3 | 0.466666667 | 2.142857 | 1 to 1 |
| 2 | 4 | 0.411764706 | 2.428571 | 5 to 4 |
| 2 | 5 | 0.35 | 2.857143 | 13 to 8 |
| 2 | 6 | 0.291666667 | 3.428571 | 9 to 4 |
| 2 | 7 | 0.269230769 | 3.714286 | 5 to 2 |
| 2 | 8 | 0.225806452 | 4.428571 | 3 to 1 |
| 2 | 9 | 0.21875 | 4.571429 | 10 to 3 |
| 2 | 10 | 0.205882353 | 4.857143 | 7 to 2 |
| 2 | 11 | 0.189189189 | 5.285714 | 4 to 1 |
| 2 | 12 | 0.184210526 | 5.428571 | 4 to 1 |
| 3 | 1 | 0.615384615 | 1.625 | 8 to 15 |
| 3 | 2 | 0.533333333 | 1.875 | 8 to 11 |
| 3 | 4 | 0.444444444 | 2.25 | 11 to 10 |
| 3 | 5 | 0.380952381 | 2.625 | 7 to 5 |
| 3 | 6 | 0.32 | 3.125 | 15 to 8 |
| 3 | 7 | 0.296296296 | 3.375 | 11 to 5 |
| 3 | 8 | 0.25 | 4 | 11 to 4 |
| 3 | 9 | 0.242424242 | 4.125 | 11 to 4 |
| 3 | 10 | 0.228571429 | 4.375 | 3 to 1 |
| 3 | 11 | 0.210526316 | 4.75 | 7 to 2 |
| 3 | 12 | 0.205128205 | 4.875 | 7 to 2 |
| 4 | 1 | 0.666666667 | 1.5 | 2 to 5 |
| 4 | 2 | 0.588235294 | 1.7 | 4 to 7 |
| 4 | 3 | 0.555555556 | 1.8 | 4 to 6 |
| 4 | 5 | 0.434782609 | 2.3 | 11 to 10 |
| 4 | 6 | 0.37037037 | 2.7 | 6 to 4 |
| 4 | 7 | 0.344827586 | 2.9 | 7 to 4 |
| 4 | 8 | 0.294117647 | 3.4 | 11 to 5 |
| 4 | 9 | 0.285714286 | 3.5 | 9 to 4 |
| 4 | 10 | 0.27027027 | 3.7 | 5 to 2 |
| 4 | 11 | 0.25 | 4 | 11 to 4 |

TABLE-continued

| Challenger | Opponent | Real Odds | 100% PO | Payout odds |
|---|---|---|---|---|
| 4 | 12 | 0.243902439 | 4.1 | 11 to 4 |
| 5 | 1 | 0.722222222 | 1.384615 | 2 to 7 |
| 5 | 2 | 0.65 | 1.538462 | 5 to 11 |
| 5 | 3 | 0.619047619 | 1.615385 | 8 to 15 |
| 5 | 4 | 0.565217391 | 1.769231 | 4 to 6 |
| 5 | 6 | 0.433333333 | 2.307692 | 11 to 10 |
| 5 | 7 | 0.40625 | 2.461538 | 5 to 4 |
| 5 | 8 | 0.351351351 | 2.846154 | 13 to 8 |
| 5 | 9 | 0.342105263 | 2.923077 | 7 to 4 |
| 5 | 10 | 0.325 | 3.076923 | 15 to 8 |
| 5 | 11 | 0.302325581 | 3.307692 | 2 to 11 |
| 5 | 12 | 0.295454545 | 3.384615 | 11 to 5 |
| 6 | 1 | 0.772727273 | 1.294118 | 2 to 9 |
| 6 | 2 | 0.708333333 | 1.411765 | 1 to 3 |
| 6 | 3 | 0.68 | 1.470588 | 5 to 13 |
| 6 | 4 | 0.62962963 | 1.588235 | 1 to 2 |
| 6 | 5 | 0.566666667 | 1.764706 | 4 to 6 |
| 6 | 7 | 0.472222222 | 2.117647 | 1 to 1 |
| 6 | 8 | 0.414634146 | 2.411765 | 5 to 4 |
| 6 | 9 | 0.404761905 | 2.470588 | 5 to 4 |
| 6 | 10 | 0.386363636 | 2.588235 | 7 to 5 |
| 6 | 11 | 0.361702128 | 2.764706 | 8 to 5 |
| 6 | 12 | 0.354166667 | 2.823529 | 13 to 8 |
| 7 | 1 | 0.791666667 | 1.263158 | 2 to 11 |
| 7 | 2 | 0.730769231 | 1.368421 | 2 to 7 |
| 7 | 3 | 0.703703704 | 1.421053 | 1 to 3 |
| 7 | 4 | 0.655172414 | 1.526316 | 2 to 5 |
| 7 | 5 | 0.59375 | 1.684211 | 4 to 7 |
| 7 | 6 | 0.527777778 | 1.894737 | 8 to 11 |
| 7 | 8 | 0.441860465 | 2.263158 | 11 to 10 |
| 7 | 9 | 0.431818182 | 2.315789 | 6 to 5 |
| 7 | 10 | 0.413043478 | 2.421053 | 5 to 4 |
| 7 | 11 | 0.387755102 | 2.578947 | 7 to 5 |
| 7 | 12 | 0.38 | 2.631579 | 7 to 5 |
| 8 | 1 | 0.827586207 | 1.208333 | 1 to 7 |
| 8 | 2 | 0.774193548 | 1.291667 | 2 to 9 |
| 8 | 3 | 0.75 | 1.333333 | 1 to 4 |
| 8 | 4 | 0.705882353 | 1.416667 | 1 to 3 |
| 8 | 5 | 0.648648649 | 1.541667 | 5 to 11 |
| 8 | 6 | 0.585365854 | 1.708333 | 4 to 7 |
| 8 | 7 | 0.558139535 | 1.791667 | 4 to 6 |
| 8 | 9 | 0.489795918 | 2.041667 | 10 to 11 |
| 8 | 10 | 0.470588235 | 2.125 | 1 to 1 |
| 8 | 11 | 0.444444444 | 2.25 | 11 to 10 |
| 8 | 12 | 0.436363636 | 2.291667 | 11 to 10 |
| 9 | 1 | 0.833333333 | 1.2 | 1 to 8 |
| 9 | 2 | 0.78125 | 1.28 | 1 to 5 |
| 9 | 3 | 0.757575758 | 1.32 | 1 to 4 |
| 9 | 4 | 0.714285714 | 1.4 | 2 to 7 |
| 9 | 5 | 0.657894737 | 1.52 | 5 to 12 |
| 9 | 6 | 0.595238095 | 1.68 | 4 to 7 |
| 9 | 7 | 0.568181818 | 1.76 | 4 to 6 |
| 9 | 8 | 0.510204082 | 1.96 | 5 to 6 |
| 9 | 10 | 0.480769231 | 2.08 | 10 to 11 |
| 9 | 11 | 0.454545455 | 2.2 | 1 to 1 |
| 9 | 12 | 0.446428571 | 2.24 | 11 to 10 |
| 10 | 1 | 0.84375 | 1.185185 | 1 to 9 |
| 10 | 2 | 0.794117647 | 1.259259 | 2 to 11 |
| 10 | 3 | 0.771428571 | 1.296296 | 2 to 9 |
| 10 | 4 | 0.72972973 | 1.37037 | 2 to 7 |
| 10 | 5 | 0.675 | 1.481481 | 2 to 5 |
| 10 | 6 | 0.613636364 | 1.62963 | 8 to 15 |
| 10 | 7 | 0.586956522 | 1.703704 | 4 to 7 |
| 10 | 8 | 0.529411765 | 1.888889 | 8 to 11 |
| 10 | 9 | 0.519230769 | 1.925926 | 4 to 5 |
| 10 | 11 | 0.473684211 | 2.111111 | 1 to 1 |
| 10 | 12 | 0.465517241 | 2.148148 | 1 to 1 |
| 11 | 1 | 0.857142857 | 1.166667 | 1 to 10 |
| 11 | 2 | 0.810810811 | 1.233333 | 1 to 6 |
| 11 | 3 | 0.789473684 | 1.266667 | 1 to 5 |
| 11 | 4 | 0.75 | 1.333333 | 1 to 4 |
| 11 | 5 | 0.697674419 | 1.433333 | 1 to 3 |
| 11 | 6 | 0.638297872 | 1.566667 | 5 to 11 |
| 11 | 7 | 0.612244898 | 1.633333 | 8 to 15 |
| 11 | 8 | 0.555555556 | 1.8 | 4 to 6 |
| 11 | 9 | 0.545454545 | 1.833333 | 8 to 11 |
| 11 | 10 | 0.526315789 | 1.9 | 4 to 5 |

TABLE-continued

| Challenger | Opponent | Real Odds | 100% PO | Payout odds |
|---|---|---|---|---|
| 11 | 12 | 0.491803279 | 2.033333 | 10 to 11 |
| 12 | 1 | 0.861111111 | 1.16129 | 1 to 10 |
| 12 | 2 | 0.815789474 | 1.225806 | 2 to 13 |
| 12 | 3 | 0.794871795 | 1.258065 | 2 to 11 |
| 12 | 4 | 0.756097561 | 1.322581 | 1 to 4 |
| 12 | 5 | 0.704545455 | 1.419355 | 1 to 3 |
| 12 | 6 | 0.645833333 | 1.548387 | 5 to 11 |
| 12 | 7 | 0.62 | 1.612903 | 1 to 2 |
| 12 | 8 | 0.563636364 | 1.774194 | 4 to 6 |
| 12 | 9 | 0.553571429 | 1.806452 | 4 to 6 |
| 12 | 10 | 0.534482759 | 1.870968 | 8 to 11 |
| 12 | 11 | 0.508196721 | 1.967742 | 5 to 6 |

When the player has completed the selection of representative boxer and opponent (18,20), the boxing contest is initiated by activating an icon (24) on the display, labelled "FIGHT!" whereafter an animation of a boxing fight is displayed as illustrated in FIGS. 3 and 4. It is an important aspect of the invention that the result of any simulated boxing match is determined randomly. If the result of the simulated boxing match is that the Challenger wins the contest, the player's wager is paid at the applicable payout odds (22), while the player's wager is forfeited if the Opponent wins the contest.

In order to determine the winner of a particular boxing contest, the computer workstation (3) instructs the gaming server (2) to generate, randomly, by means of a random number generator (8), a number in a range that is a function of the respective skill ratings of the Challenger and the Opponent. For example, suppose the player has selected boxer no. 1 as the Challenger, with a skill rating of 5, and boxer no. 4 as the Opponent, with a skill rating of 10. The respective skill ratings are summed to give a total of 15 and the random number generator (8) is activated to generate a random number in the range 1 to 15. If the generated random number is in the range 1 to 5, the result of the contest is taken to be a win by the Challenger, while a generated random number in the range 6 to 15 is interpreted as a win by the Opponent. The operation of such a software random number generator (8) is well known in the art and will not be described here in detail. The gaming server (2) then transmits the result of the boxing contest to the computer workstation (3) along the communication network (4) for display by the stored simulation software program (5) to the player on the display of the computer workstation (3). The stored program (7) in the gaming server (2) determines the outcome of player's wager according to the rules of the game described above.

If the player's wager is successful, the player's payout can either be collected and the turn of the game terminates, or can be used as a stake for a next round of the boxing contest. If the player elects to proceed to the next round of the contest, the player is again required to select a boxing character (18) as the Challenger and a boxing character (20) to represent the Opponent. These can be the same or different characters to those in previous rounds of the boxing tournament. The selection is performed in the same manner as described above. There is no limitation to the number of rounds the player can go through in this manner, but there is a maximum win limit of 5000 units on the game, irrespective of the player's starting wager. The turn of the game terminates automatically if this limit is reached.

It will be appreciated by those skilled in the art that the game described in this embodiment is a boxing-themed fixed-odds accumulator game, the aim of the game being to win boxing bouts and to advance through different rounds to accumulate more winnings. The game terminates either when the player banks any accumulated winnings, or when the player's chosen boxing character loses a bout, at which time the player loses the wager and any accumulated winnings.

Once the animation has been completed and the stored program (7) has settled the player's wager, the turn of the game is complete and the player may begin a further turn of the game by making another wager on the computer workstation (3).

Numerous modifications are possible to this embodiment without departing from the scope of the invention. In particular, the number of boxing character in the pool of available boxers may be larger or smaller than the 12 characters in this embodiment. Further the span of the skills ratings of the boxing characters may be decreased or increased from that described above in order to decrease or to increase the payout odds of the game, respectively.

The invention therefore provides a novel boxing-themed fixed-odds accumulator game that enables a player to place wagers an on-line environment.

The invention claimed is:

1. An entertainment system, comprising:

a gaming server operable under stored program control to regulate a game of chance having a boxing theme;

a communication network providing communication between the gaming server and a player station operable by a player, wherein the player station is operable to receive a selection of two participants that will participate in a simulated boxing contest displayed the game; and a wagering means operable by the player to place a wager on an outcome of the boxing contest, the outcome being either a successful outcome in which the player wins a prize or an unsuccessful outcome in which the player forfeits the wager, wherein the two participants that participate in the boxing contest include a first participant and a second participant, wherein the first participant is associated with a first numeric skill rating, wherein the second participant is associated with a second numeric skill rating, wherein the gaming server determines a sum of the first numeric skill rating and the second numeric skill rating, wherein the gaming serve generates a random number in a range of 1 to the sum of the first numeric skill rating and the second numeric skill rating, wherein the first participant is determined to win the boxing contest if the random number is in a range of 1 to the first numeric skill rating, and wherein the second participant is determined to win the boxing contest if the random number is in a range of a sum of the first numeric skill rating and 1 to the sum of the first numeric skill rating and the second numeric skill rating.

2. An entertainment system as claimed in claim 1 in which the player station enables the player to select the two participants for the boxing contest from a pool of available participants each having a corresponding skill rating, one of the two selected participants representing the player.

3. An entertainment system as claimed in claim 2 in which the gaming server determines payout odds for the wager as a function of the two participants that participate in the boxing contest for which the outcome of that boxing contest the wager was placed.

4. An entertainment system as claimed in claim 3 in which the gaming server determines the winner of the boxing contest randomly as a function of the respective skill ratings of the two participants that participate in the boxing contest.

5. An entertainment system as claimed in claim 4 in which the outcome of the boxing contest is a successful outcome if the gaming server determines the participant representing the player to be the winner of the boxing contest.

6. An entertainment system as claimed in claim 5 in which the prize for the successful outcome of the boxing contest is settlement of the wager placed on the outcome of the boxing contest at the payout odds determined by the gaming server.

7. An entertainment system as claimed in claim 6 in which the prize won on the successful outcome of the boxing contest may be selectively collected or carried over as a wager for a succeeding boxing contest.

8. An entertainment system as claimed in claim 7 in which the game terminates automatically when the player collects the prize won on the successful outcome of the boxing contest or when the prize exceeds a predetermined threshold.

9. An entertainment system as claimed in claim 1 in which the simulated boxing contest is an animated bout.

10. A method of operation of an entertainment system, comprising the steps of:

operating a gaming server under program control to regulate a game of chance having a boxing theme;

a player station receiving a selection of two participants that will participate in a simulated boxing contest displayed by the player station during the game;

providing communication between the gaming server and the player station; and placing a wager on an outcome of the boxing contest, the outcome being either a successful outcome in which a prize is won or an unsuccessful outcome in which the wager is forfeited, wherein the two participants that participate in the boxing contest include a first participant and a second participant, wherein the first participant is associated with a first numeric skill rating, wherein the second participant is associated with a second numeric skill rating, wherein the gaming server determines a sum of the first numeric skill rating and the second numeric skill rating, wherein the gaming server generates a random number in a range of 1 to the sum of the first numeric skill rating and the second numeric skill rating, wherein the first participant is determined to win the boxing contest if the random number is in a range of 1 to the first numeric skill rating, and wherein the second participant is determined to win the boxing contest if the random number is in a range of a sum of the first numeric skill rating and 1 to the sum of the first numeric skill rating and the second numeric skill rating.

11. A method as claimed in claim 10, wherein the two participants that will participate in the simulated boxing contest are selected from a pool of available participants, wherein each of the available participants has a corresponding skill rating, and wherein one of the two participants that will participate in the simulated boxing contest represents a player of the game of chance.

12. A method as claimed in claim 11, further comprising:

the gaming server determining payout odds for the wager as a function of the two participants that participate in the boxing contest for which the outcome of that boxing contest the wager was placed.

13. A method as claimed in claim 12 in which the winner of the boxing contest is determined randomly as a function of the respective skill ratings of the two participants that participate in the respective boxing contest.

14. A method as claimed in claim 13 in which the outcome of the boxing contest is a successful outcome if the participant representing the player is determined to be the winner of the boxing contest.

15. A method as claimed in claim 14, further comprising:

awarding a prize for the successful outcome of the boxing contest as settlement of the wager placed on the outcome of the boxing contest at the payout odds determined by the gaming server.

16. A method as claimed in claim 15 in which the prize won on the successful outcome of the boxing contest is collected or carried over, selectively, as a wager for a succeeding boxing contest.

17. A method as claimed in claim 16 in which the game is terminated automatically when the prize won on the successful outcome of the boxing contest is collected or when the prize exceeds a predetermined threshold.

18. A method as claimed in claim 10 in which the boxing contest is displayed as an animated bout.

19. The entertainment system of claim 3, wherein the player station displays the payout odds for the wager on an outcome of the boxing contest prior to display of that boxing contest.

20. The entertainment system of claim 1, wherein the player wins the prize if the random number is within the range of 1 to the sum of the first numeric skill rating and the second numeric skill rating, and wherein the player forfeits the wager if the random number is within the range of the sum of the first numeric skill rating and 1 to the sum of the first numeric skill rating and the second numeric skill rating.

21. The entertainment system of claim 1, wherein the player wins the prize if the random number is within the range of the sum of the first numeric skill rating and 1 to the sum of the first numeric skill rating and the second numeric skill rating, and wherein the player forfeits the wager if the random number is within the range of 1 to the sum of the first numeric skill rating and the second numeric skill rating.

22. The method of claim 10, wherein the player wins the prize if the random number is within the range of 1 to the sum of the first numeric skill rating and the second numeric skill rating, and wherein the player forfeits the wager if the random number is within the range of the sum of the first numeric skill rating and 1 to the sum of the first numeric skill rating and the second numeric skill rating.

23. The method of claim 10, wherein the player wins the prize if the random number is within the range of the sum of the first numeric skill rating and 1 to the sum of the first numeric skill rating and the second numeric skill rating, and wherein the player forfeits the wager if the random number is within the range of 1 to the sum of the first numeric skill rating and the second numeric skill rating.

* * * * *